US011408157B2

(12) United States Patent
Wollmer et al.

(10) Patent No.: US 11,408,157 B2
(45) Date of Patent: Aug. 9, 2022

(54) FIXTURE POD FOR A LAVATORY FIXTURE

(71) Applicant: Bradley Fixtures Corporation, Menomonee Falls, WI (US)

(72) Inventors: James A. Wollmer, Menomonee Falls, WI (US); Graeme S. Bayley, Brookfield, WI (US); Jeffery S. Jaworski, Sussex, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 0 days.

(21) Appl. No.: 16/685,661

(22) Filed: Nov. 15, 2019

(65) Prior Publication Data

US 2020/0157788 A1 May 21, 2020

Related U.S. Application Data

(60) Provisional application No. 62/768,301, filed on Nov. 16, 2018.

(51) Int. Cl.
*E03C 1/04* (2006.01)
*E03C 1/046* (2006.01)

(52) U.S. Cl.
CPC ..... *E03C 1/0404* (2013.01); *E03C 1/046* (2013.01)

(58) Field of Classification Search
USPC ..... 801/137
See application file for complete search history.

(56) References Cited

U.S. PATENT DOCUMENTS 5,025,516 A * 6/1991 Wilson ..... E03C 1/057 250/221
5,062,164 A 11/1991 Lee et al.
5,224,509 A * 7/1993 Tanaka ..... E03C 1/057 137/315.03
5,555,912 A * 9/1996 Saadi ..... E03C 1/0404 137/801
6,003,170 A * 12/1999 Humpert ..... E03C 1/057 251/129.03
6,006,784 A 12/1999 Tsutsui et al.
6,513,787 B1 * 2/2003 Jeromson ..... E03C 1/057 137/559
6,691,340 B2 * 2/2004 Honda ..... E03C 1/057 4/623
7,228,874 B2 6/2007 Bolderheij et al.
8,549,677 B2 10/2013 Weigen et al.
8,939,429 B2 * 1/2015 Sawaski ..... E03C 1/0404 251/129.04

(Continued)

FOREIGN PATENT DOCUMENTS

DE 102013017781 A1 * 4/2015 ..... E03C 1/086
EP 2511434 2/2018
JP 2015113604 6/2015

OTHER PUBLICATIONS

DE102013017781A1, PE2E Search Machine Translation (Year: 2013).*
Extended European Search Report, dated Jul. 1, 2022, EP 19884153.8-1005, PCT/US2019/061796.

*Primary Examiner* — Daphne M Barry
(74) *Attorney, Agent, or Firm* — Boyle Fredrickson, S.C.

(57) ABSTRACT

A fixture pod assembly retained within an outlet of a fixture includes a main body having an inlet and an outlet, a dispersion element retained within the outlet of the main body, and a sensor disposed within an opening of the main body. The dispersion element may be either an aerator or a soap dispenser.

20 Claims, 12 Drawing Sheets

(56) References Cited

U.S. PATENT DOCUMENTS

| | | | | |
|---|---|---|---|---|
| 9,133,607 | B2 | 9/2015 | Schoolcraft et al. | |
| 9,587,384 | B2 | 3/2017 | Schoolcraft et al. | |
| 2006/0130907 | A1 | 6/2006 | Marty et al. | |
| 2014/0109985 | A1* | 4/2014 | Itazu | E03C 1/057 137/78.1 |
| 2014/0116553 | A1* | 5/2014 | Schoolcraft | E03C 1/057 137/801 |
| 2017/0275857 | A1* | 9/2017 | DiDea | E03C 1/0404 |
| 2019/0264429 | A1* | 8/2019 | Sawaski | F21V 33/004 |

* cited by examiner

FIXTURE POD FOR A LAVATORY FIXTURE

CROSS-REFERENCE TO RELATED APPLICATIONS

The present application claims priority to U.S. Provisional Patent Application No. 62/768,301, filed on Nov. 16, 2018. The entire contents of which are incorporated by reference herein.

BACKGROUND OF THE INVENTION

1. Field of the Invention

The present invention relates in general to a lavatory fixture. More particularly, the present invention relates to a fixture pod assembly retained within an outlet of a lavatory fixture. Even more particularly, the present invention relates to a fixture pod assembly configured to retain a dispersion element and a sensor at the outlet of the fixture.

2. Discussion of the Related Art

Fixtures in the current art include dispensing elements and sensors separately secured within the fixture at the distal end and opening of the fixture. For instance, sensors are usually secured within the fixture in a location inaccessible without taking apart the fixture. Similarly, dispensing elements are usually secured within the opening of the fixture so as to require taking apart the fixture or a tool specifically configured to engage the dispensing element. As a result, servicing of the sensors and the dispensing elements requires a complicated disassembly of the fixture in order to remove the sensor and dispensing element.

As such, there is a need in the art for a fixture pod assembly that is easily inserted and removed from the fixture for ease of installation and servicing. The fixture pod includes both a dispensing element and a sensor that can then be easily serviced after the fixture pod is removed from the fixture. The fixture pod assembly of the present invention allows for installation and servicing with minimal tooling and time. In addition, there is a need for a fixture pod assembly that includes the dispensing element and the sensor of a fixture in a single easy to remove location.

SUMMARY AND OBJECTS OF THE INVENTION

The present invention is directed to a lavatory unit or fixture having fixture pod assembly incorporating a dispersion element, such as an aerator or soap dispenser, and sensor. Additionally, the fixture pod assembly is easily inserted and retained within an outlet of the fixture with use of minimal equipment.

According to an embodiment of the invention, a fixture pod assembly retained within an outlet of a fixture includes a main body having an inlet, an outlet, and a cavity extending between the inlet and outlet, a dispersion element retained within the outlet of the main body, and a sensor disposed within an opening of the main body. The dispersion element may be either an aerator or a soap dispenser.

In accordance with another aspect of the invention, the main body of the fixture pod may include a framing member forming the periphery of the sensor opening and surrounding the sensor. The sensor may be secured to the framing member by at least one fastener. The main body may also include interfit elements extending laterally outward and into an interior of the fixture.

In accordance with yet another aspect of the invention, the main body may include an inner portion within an interior of the fixture, an outer portion disposed outside the interior of the fixture, and an intermediate portion disposed within the outlet of the fixture.

In accordance with another aspect of the invention, a channel may extend between the inlet and the outlet of the main body of the fixture pod assembly. The outlet and the channel may be aligned along an axis, while the inlet is oriented perpendicular to the axis. In other embodiments, the outlet and the channel may be aligned along an axis, while the inlet is oriented at an angle to the axis.

According to another embodiment of the invention, a lavatory unit includes a fixture and a fixture pod assembly retained within an outlet of the fixture. The fixture pod assembly includes a main body having an inlet and an outlet, a dispersion element retained within the outlet of the main body, and a sensor disposed within an opening of the main body. A supply line may extend through an interior of the fixture, more specifically from an inlet of the fixture to the inlet of the main body of the fixture pod assembly.

In accordance with yet another aspect of the invention, the main body of the fixture pod assembly may include a framing member as the periphery of the opening and surrounding the sensor. The sensor may be secured to the framing member via at least one fastener. In addition, the pod assembly may include locking dogs extending from the main body an into the interior of the fixture to assist in securing the fixture pod assembly within the outlet of the fixture.

In accordance with another aspect of the invention, a channel may extend between the inlet and outlet of the main body of the fixture pod assembly. The outlet and the channel may be aligned along an axis. Meanwhile, the inlet may be oriented at an angle to the axis. For example, the angle may be perpendicular to the axis or any angle between 0° and 90°.

According to yet another embodiment of the invention, a method of installing a fixture pod assembly in a fixture includes disposing a main body of the fixture pod assembly in an outlet of the fixture, inserting a dispersion element into an outlet of the main body of the fixture pod assembly, and inserting a sensor into an opening formed in the main body of the fixture pod assembly. In addition, a supply line may be secured to an inlet of the main body of the fixture pod assembly.

In accordance with another aspect of the invention, locking dogs may be inserted into an interior of the fixture. The locking dogs are oriented to extend laterally from the main body of the fixture pod assembly. The sensor may be secured to the main body of the fixture pod via at least one fastener. Further, the main body of the fixture pod assembly may be secured to the fixture via at least one fastener.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
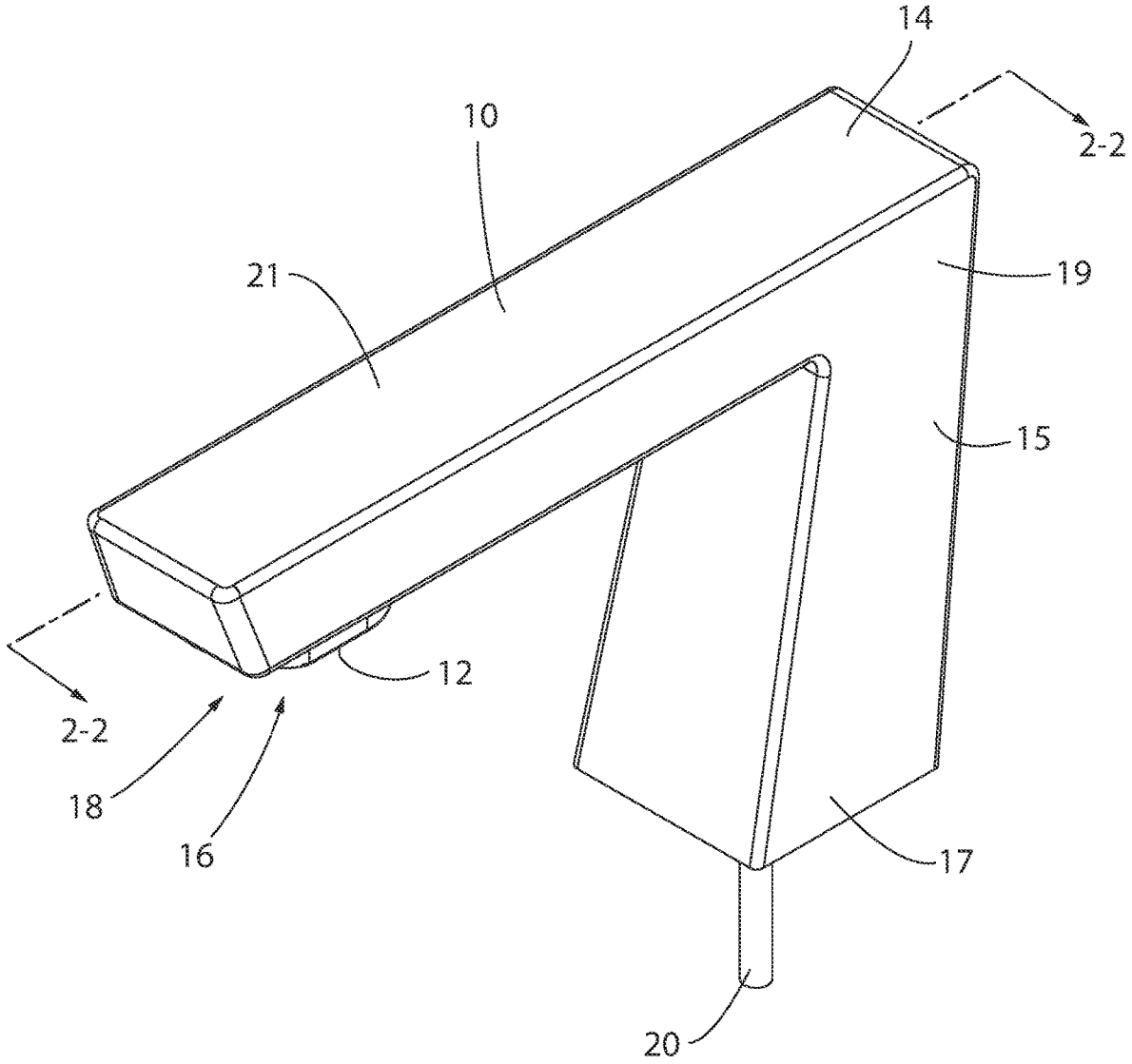
FIG. 1 is a perspective view of a lavatory unit or fixture including a pod assembly, according to an embodiment of the present invention.

In describing the preferred embodiment of the invention which is illustrated in the drawings, specific terminology will be resorted to for the sake of clarity. However, it is not intended that the invention be limited to the specific terms so selected, and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

Throughout this description, various terms denoting direction, such as left and right, front and rear, up and down, top and bottom, and the like may be used. The directions are not intended to be limiting but are used to describe relationships of elements with respect to each other in the accompanying drawings. Unless mutually exclusive, it is contemplated that the elements may be reversed, for example, by turning a component around or upside down without deviating from the scope of the present invention.

Figure 2:
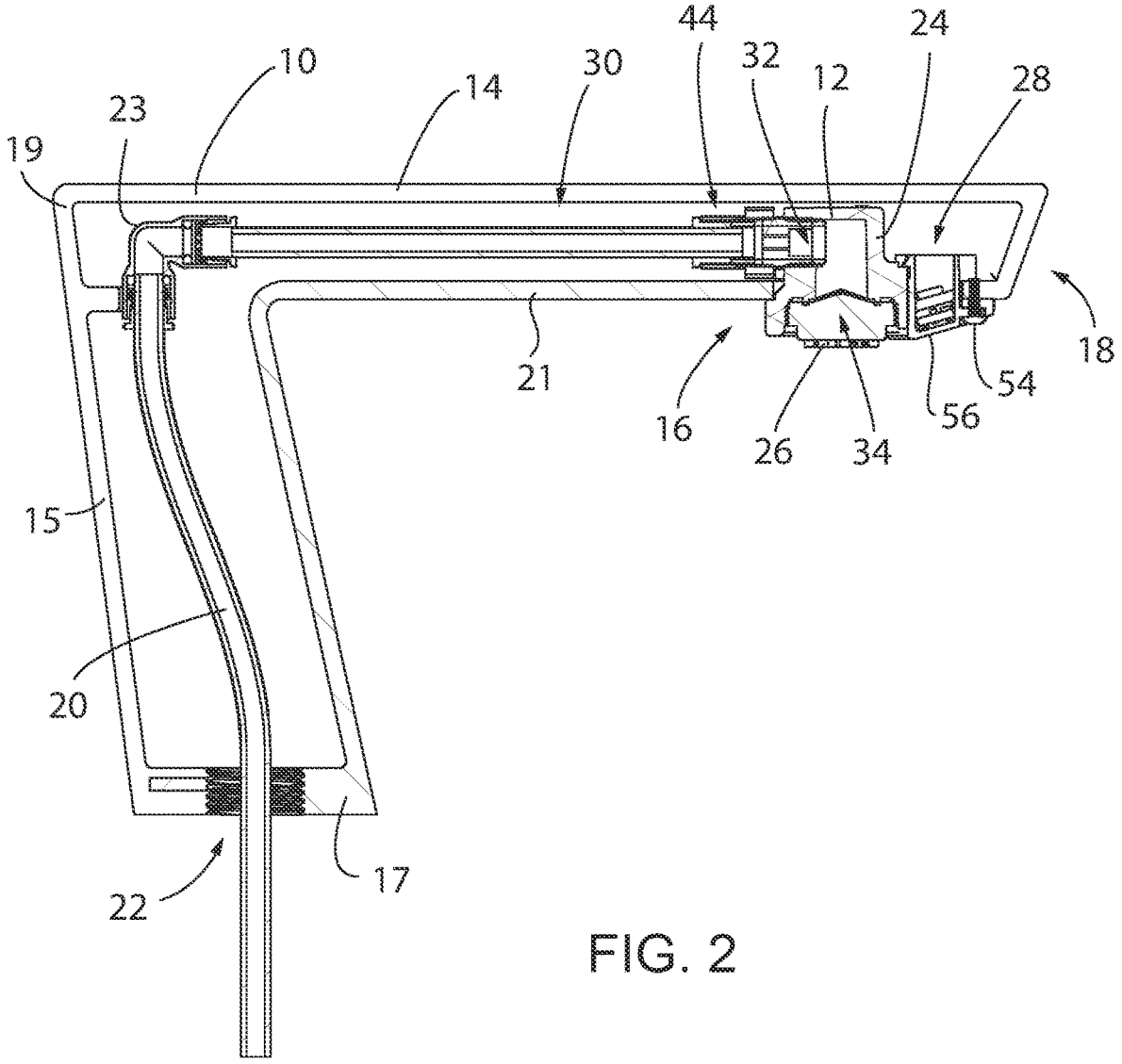
FIG. 2 is cross-sectional view of the lavatory fixture of FIG. 1 taken along line 2-2.
Figure 3:
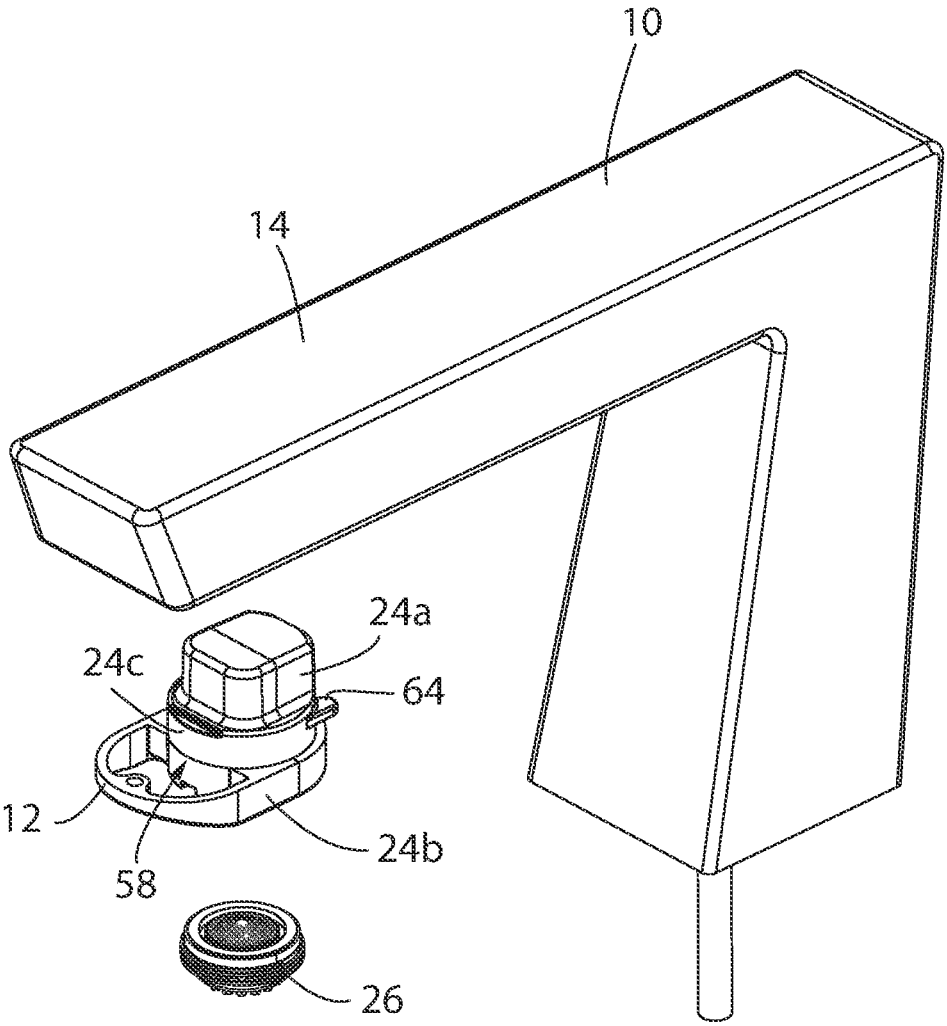
FIG. 3 is an exploded perspective view of the lavatory fixture of FIG. 1.
Figure 3:
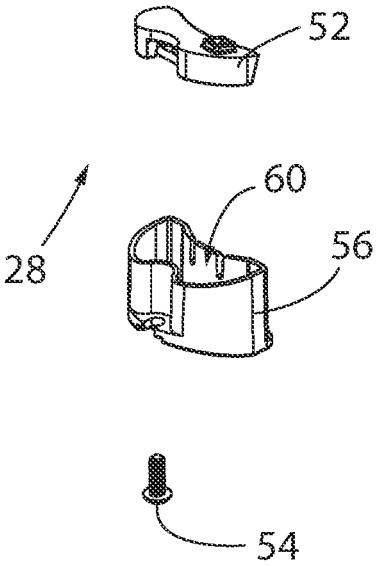

Referring first to FIGS. 1-3, a lavatory unit or fixture 10 including a fixture pod assembly 12 is shown. The fixture 10 includes a main body 14 having an outlet 16 disposed at a distal end 18 of the main body 14. The pod assembly 12 is disposed within the outlet 16 of the main body 14. A supply line 20 extends from the pod assembly 12 through the main body 14 of the fixture 10 to an inlet 22 of the main body 14 of the fixture 10.

In the representative embodiment of the invention, the main body 14 of the fixture 10 includes a first portion 15 extending upward from a first end 17 to a second end 19. In turn, the main body 14 includes a second portion 21 that extends outward from the second end 19 of the first portion 15 to the distal end 18 of the main body 14. While FIGS. 1-3 depict the second portion 21 extending horizontally from the second end 19 of the first portion 15, the second portion 21 may extend from the second end 19 of the first portion 15 at any angle in varying embodiment of the invention. In some embodiments of the invention, the supply line 20 may include an angled bend 23 to adjust the orientation of the supply line 20 as the main body 14 transitions from the first portion 15 to the second portion 21.

The pod assembly 12 includes a main body 24, a dispensing element 26 and a sensor 28 coupled together and retained within the outlet 16 of the fixture 10. FIG. 3 illustrates an exploded view of the main body 24, dispensing element 26, and sensor 28 of the pod assembly 12 and its relation to the fixture 10. The arrangement of the dispensing element 26 and the sensor 28 within the pod assembly 12 will be described in further detail below. In FIGS. 1-6, the dispensing element 26 is shown as an aerator. However, the dispensing element 26 may be in the form of other dispensing elements in varying embodiments of the invention.

As described above, the pod assembly 12 is partially disposed within the outlet 16 of the faucet 10. As such, the main body 24 of the pod assembly 12 includes an inner portion 24*a* disposed within an interior 30 of the main body 14 of the fixture 10, an outer portion 24*b* disposed outside the main body 14 of the fixture 10, and an intermediate portion 24*c* disposed between the inner and outer portions 24*a*, 24*b*. As shown in FIG. 2, the intermediate portion 24*c* is disposed within the outlet opening 16 of the fixture 10 and extending into the interior 30 of the fixture 10.

Figure 4:
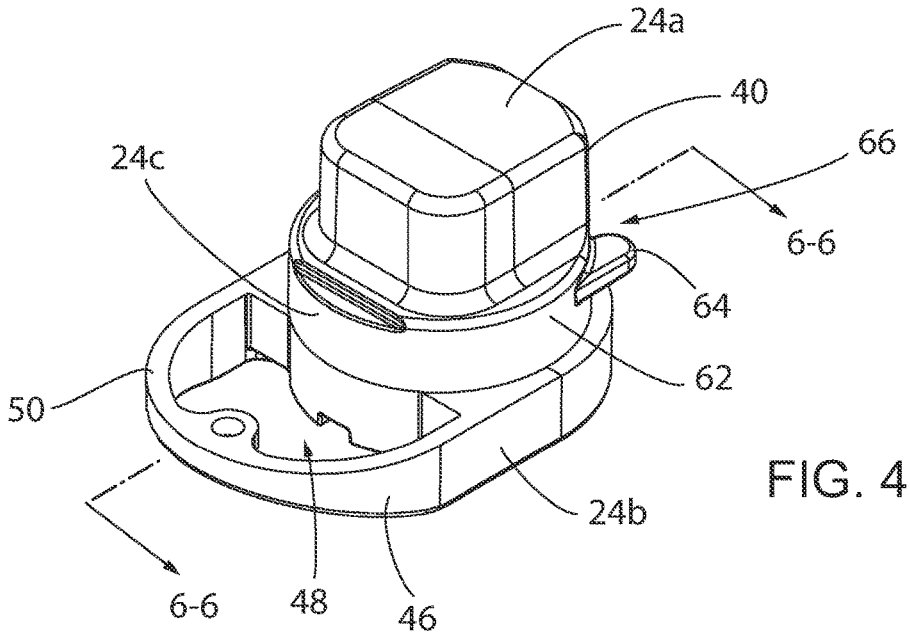
FIG. 4 is a perspective view of the pod assembly of the lavatory fixture of FIG. 1.
Figure 5:
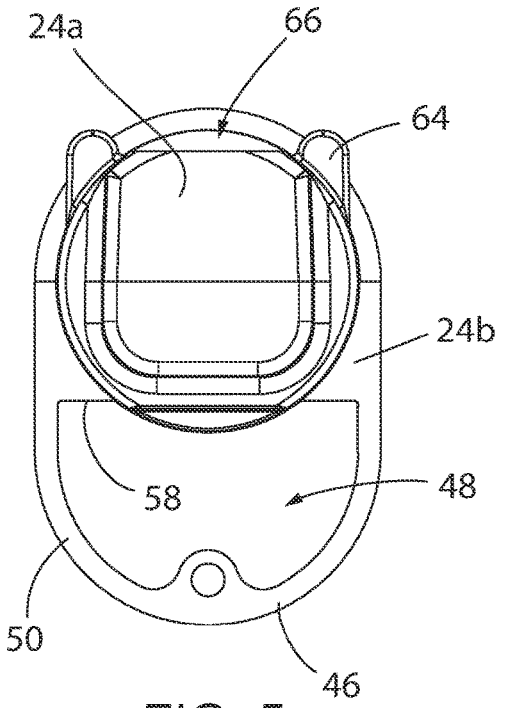
FIG. 5 is a top view of the pod assembly of FIG. 4.
Figure 6:
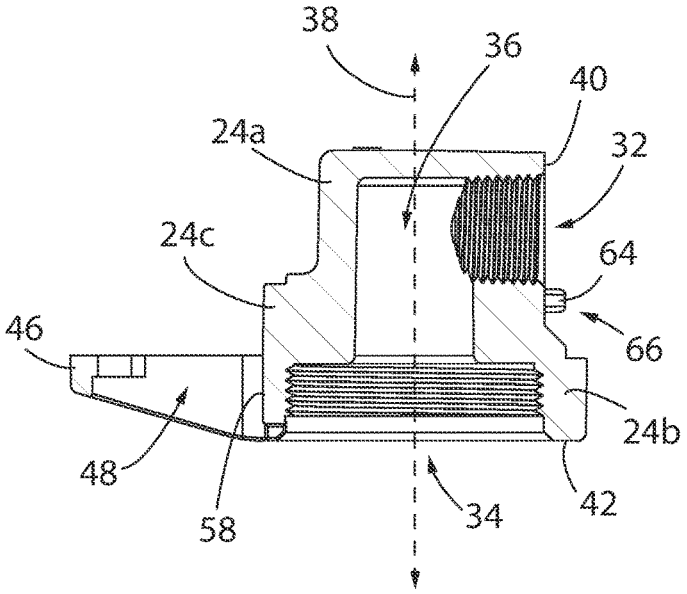
FIG. 6 is a cross-sectional view of the pod assembly of FIG. 4 taken along line 6-6.
Figure 7:
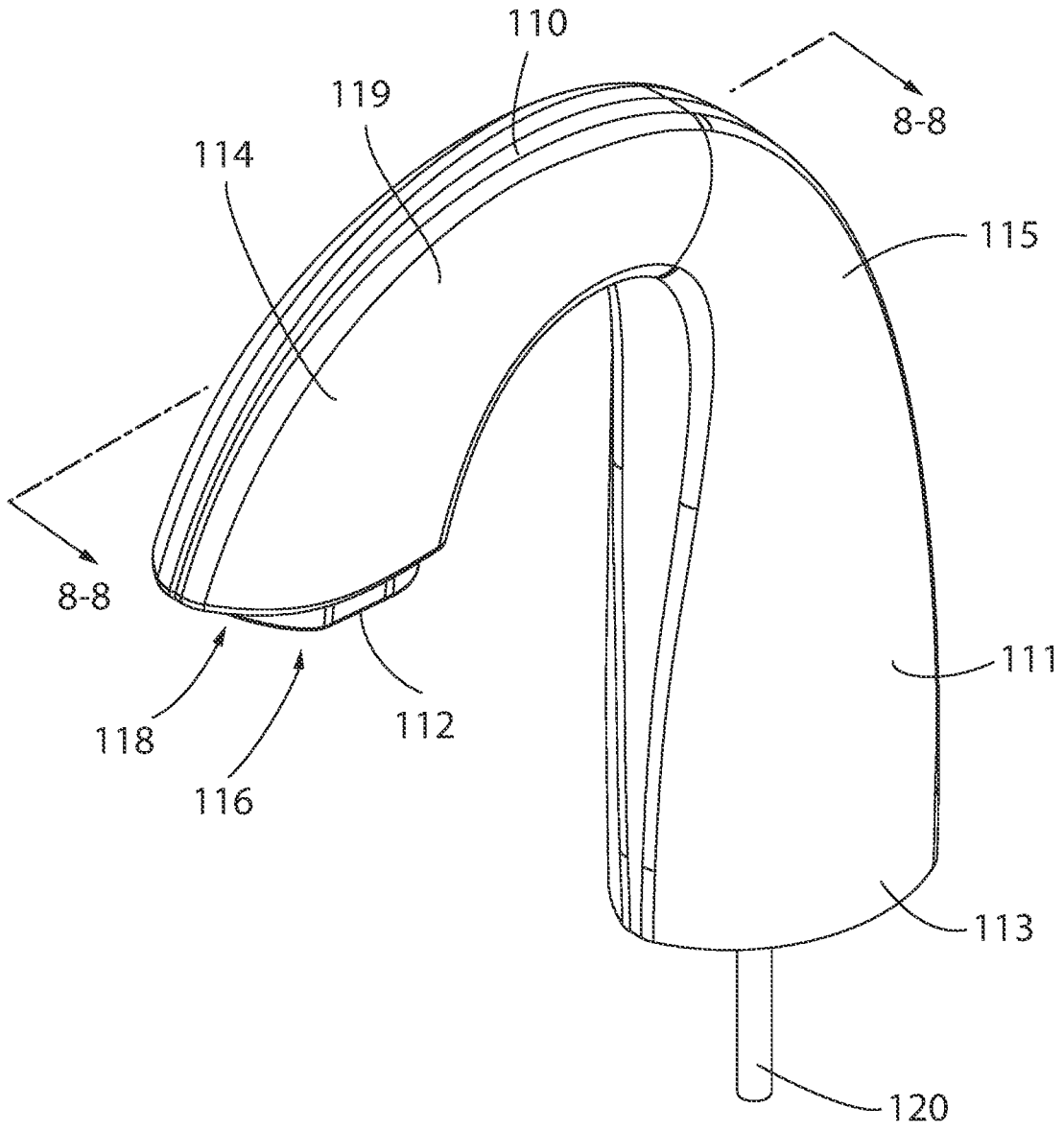
FIG. 7 is a perspective view of a lavatory fixture including a pod assembly, according to another embodiment of the present invention.

FIGS. 4-6 depict the pod assembly 12 in greater detail. The main body 24 of the pod assembly 12 includes an inlet 32 and an outlet 34. The main body 24 further includes a channel 36 extending from the inlet 32 to the outlet 34 in order to direct a fluid from the inlet 32 to the outlet 34. As shown in FIGS. 2 and 6, the channel 36 is oriented along a vertical axis 38. The inlet 32 of the pod assembly 12 is disposed in the inner portion 24*a* of the main body 24. In the representative embodiment of the invention, the inlet 32 is disposed in a sidewall 40 of the inner portion 24*a* of the main body 24. While FIGS. 2 and 6 illustrates the inlet 32 disposed perpendicular to the channel 36, it is contemplated that the inlet 32 may be oriented at any other angle, in varying embodiments of the invention. Meanwhile, the outlet 34 is aligned with the channel 36 and disposed in a bottom surface 42 of the outer portion 24*b* of the main body 24. While FIG. 6 depicts the outlet 34 being disposed along the same axis as the channel 36, it is contemplated that the outlet 34 may be oriented at any angle from the channel 36 or be offset from the channel 36, in other embodiments of the invention.

In the representative embodiment of the invention, the inner portion 24*a* of the main body 24 is depicted as being generally rectangular in shape with four sidewalls 40. As discussed above, the inlet 32 of the pod assembly 12 is disposed in one of the sidewalls 40. As shown in FIG. 2, the inlet 32 of the pod assembly 12 is preferably disposed in the rearmost sidewall 40*a* of the inner portion 24*a*. However, in alternative embodiments of the invention, the inner portion 24*a* may be in the form of any shape and include any number of sidewalls 40. Further, the inlet 32 may be disposed in any sidewall 40 of the inner portion 24*a*.

The aerator 26 is disposed within the outlet 34 of the pod assembly 12. In the representative embodiment of the invention, the aerator 26 is threadably engaged with the outlet 34 in order to secure the aerator 26 within the outlet 34. In other embodiments of the invention, the aerator 26 may be secured within the outlet 34 of the pod assembly 12 by other means. A distal end 44 of the supply line 20 is disposed within the inlet 32 of the pod assembly 12. As shown in FIG. 2, the supply line 20 is threadably engaged with the inlet 32 of the pod assembly 12 to secure the distal end 44 of the supply line 20 within the inlet 32. In turn, the supply line 20 extends from the inlet 32 along the same angle as the inlet 32. As previously stated, the angle of the inlet 32 may vary in other embodiments of the invention. In such other embodiments, the angle of the inlet 32 is configured to allow the supply line 20 to extend through the interior 30 of the fixture 10 at an angle either the same as or similar to the angle of the second portion 21 of the housing 14. It is also contemplated that other embodiments of the invention may use alternative methods to secure the distal end 44 of the supply line 20 within the inlet 32 of the pod assembly 12.

In the representative embodiment of the invention shown in FIGS. 3-6 the outer portion 24*b* of the pod assembly 12 includes a sensor mount 46 extending laterally therefrom. While the representative embodiment of the invention depicts the sensor mount 46 extending from a front side 58 of the outer portion 24*b*, it is contemplated that the sensor mount 46 may extend from any side of the outer portion 24*b*. The sensor mount 46 includes a sensor opening 48 surrounded by a framing member 50. The framing member 50 and the main body 24 may be formed as a single piece. In other embodiments of the invention, the framing member 50 and the main body 24 may be formed as separate pieces coupled together.

The sensor 28 extends through the sensor opening 48. While the representative embodiment of the invention depicts at least one fastener 54 to secure the sensor 28 to the framing member 50 of the pod assembly 12 and the fixture 10, it is contemplated that the sensor 28 may be secured to the framing member 50 by other methods. As shown in FIG. 2, the fastener 54 extends through the framing member 50 and secures the pod assembly 12 to the housing 14 of the fixture 10 at a location adjacent the outlet 16. It is further contemplated that other embodiments of the invention may use alternative methods to secure the three elements to each other. The sensor 28 includes a sensor housing 56 and a sensor board 52 disposed therein. As shown in FIGS. 2 and 3, the sensor housing 56 includes a cavity 60 formed therein, and the sensor board 52 is disposed within the cavity 60. While FIG. 2 illustrate the sensor board 52 being located at the bottom of the cavity 60, varying embodiments of the invention may have the sensor board 52 positioned at any location within the cavity 60. The sensor housing 56 is sized to fit within the sensor opening 48.

In the representative embodiment of the invention, the intermediate portion 24*c* of the main body 24 is depicted as being circular in shape with a single circular sidewall 62. In other embodiments of the invention, the intermediate portion 24*c* may be in the form of any other shape having any number of sidewalls 62. FIGS. 3-6 further depict interfit elements 64, such as locking dogs, that extend inward from the intermediate portion 24*c* of the main body 24 at a location above the inlet 22 of the fixture 10. While the representative embodiment of the invention illustrates the locking dogs 64 as extending from a rear side 66 of the intermediate portion 24*c*, it is contemplated that the locking dogs 64 may extend from any side of the intermediate portion 24*c*. It is preferable that the locking dogs 64 extend from a side of the intermediate portion 24*c* not aligned with the side of the exterior portion 24*b* from which the sensor mount 46 extends. As described above, the locking dogs 64 extend from the intermediate portion 24*c* at a location above the inlet 22 of the fixture 10. As such, the locking dogs 64 extend into the interior 30 of the fixture 10 to assist in securing the pod assembly 12 within the outlet 16 of the fixture 10.

FIG. 2 further illustrates the pod assembly 12 within the outlet 16 of the fixture 10. As shown, the outer portion 24*b* of the pod assembly 12 is disposed outside of the fixture 10 and is sized to be larger than the outlet 16 of the fixture 10. That is, the outer portion 24*b* of the pod assembly 12 overlaps the fixture 10 when the pod assembly 12 is inserted in the outlet 16 of the fixture 10. The intermediate portion 24*c* is sized to fit within the outlet 16 of the fixture 10, while also allowing the sensor 28 to extend into the interior 30 of the fixture 10. Further yet, as described above, the locking dogs 64 of the intermediate portion 24*c* are configured to extend laterally into the interior 30 of the fixture 10 to assist in securing the pod assembly 12 within the fixture 10. Concurrently, the previously described fastener 56 assists in coupling the framing member 50 of the sensor mount 46 of the pod assembly 12 and the sensor 28 itself to the fixture 10.

Referring next to FIGS. 7-12, a fixture 110 and a fixture pod assembly 112 are shown according to another embodiment of the invention. The fixture 110 includes a main body 114 having an outlet 116 at a distal end 118 of the main body 114. In the representative embodiment of the invention, the fixture 110 includes a first portion 111 extending upward from a first end 113 to a second end 115. In turn, the main body 114 includes a second portion 119 that extends from the second end 115 of the first portion 111 along a curve and to the distal end 118 of the main body 114.

The pod assembly 112 is disposed within the outlet 116 of the main body 114, and a supply line 120 extends from the pod assembly 112, through the main body 114 of the fixture 110, and to an inlet 122 of the main body 114 of the fixture 110. The pod assembly 112 itself includes a main body 124, a dispensing element 126, and a sensor 128, all of which is retained within the outlet 116 of the fixture 110. While FIGS. 7-12 depict the dispensing element 126 as being an aerator, it is contemplated that the dispensing element 126 may be in other forms in alternative embodiments of the invention.

Figure 8:
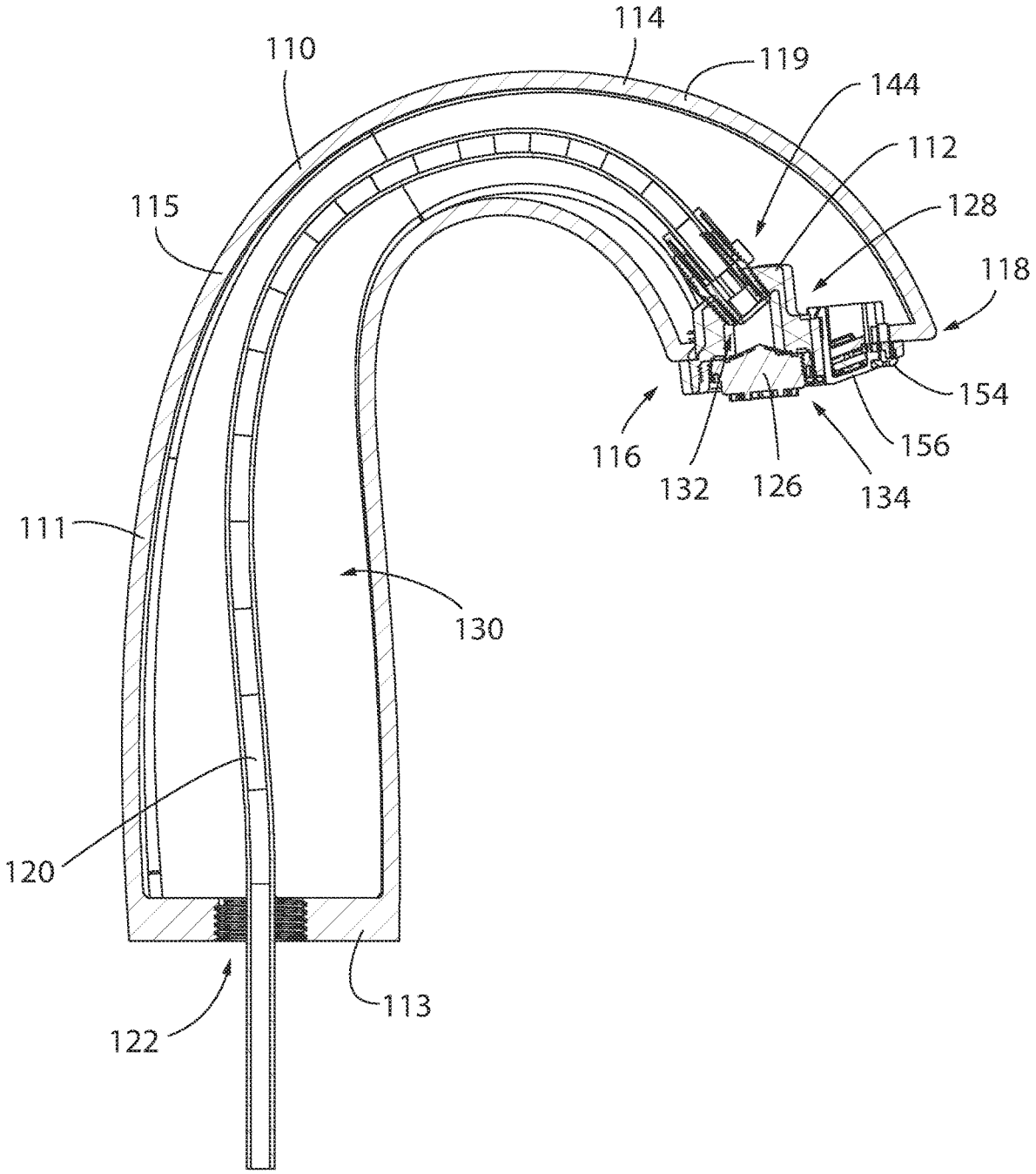
FIG. 8 is a cross-sectional view of the lavatory fixture of FIG. 7 taken along line 8-8.

FIGS. 8-12 further depict the arrangement and orientation of the fixture pod assembly 112. The pod assembly 112 includes a main body 124. The main body 124 includes three portions: an inner portion 124*a* disposed within an interior 130 of the main body 114 of the fixture 110; an outer portion 124*b* disposed outside the main body 114 of the fixture 110; and an intermediate portion 124*c* extending between the inner and outer portions 124*a*, 124*b*. FIG. 8 further depicts the intermediate portion 124*c* as being disposed within the outlet 116 of the fixture 110 and extending into the interior 130 of the fixture 110. The inner portion 124*a*, outer portion

124*b*, and intermediate portion 124*c* of the main body 124 may be formed as a single piece or any number of separate pieces coupled together.

FIGS. 9-12 further illustrate the features of the pod assembly 112. The main body 124 of the pod assembly 112 includes an inlet 132 and an outlet 134. The inlet 132 is located in a sidewall 140 of the inner portion 124*a* of the pod assembly 112. Meanwhile, the outlet 134 is located in a bottom surface 142 of the outer portion 124*b* of the pod assembly 112. A channel 136 extends between to fluidically couple the inlet 132 to the outlet 134. The channel 136 and the outlet 134 are both oriented along an axis 138. In the representative embodiment of the invention, the inlet 132 is formed in an angled sidewall 140 of the inner portion 124*a*, so as to orient the inlet 132 at an angle with respect to axis 138 of the channel 136. While FIGS. 8-12 depict the angle as being 30° from the axis 138, it is contemplated that other embodiments may include an inlet 132 oriented at any angle between 0° and 90° degrees from the axis 138 and an angled sidewall 140 oriented accordingly.

The inner portion 124*a* of the main body 124 is depicted as being generally rectangular in shape and having the above discussed angled sidewall 140. In alternative embodiments of the invention, the inlet 132 may be disposed in any of the sidewalls of the inner portion 124*a*. Further, the inner portion 124*a* may be in the form of any shape with any number of sidewalls. Even further, while FIGS. 8-12 depict the angled wall 140 as being disposed at a rear side 140*a* of the inner portion 124*a*, it is contemplated that the angled wall 140 may be disposed at any side of the inner portion 124*a*.

As previously discussed, the pod assembly 112 includes a dispensing element 126 in the form of an aerator. The aerator 126 is disposed within the outlet 134 of the pod assembly 112. In the representative embodiment of the invention, the aerator 126 is secured within the outlet 134 via a threaded engagement. However, it is contemplated that other embodiments may use other methods to secure the aerator 126 within the outlet 134. A distal end 144 of the supply line 120 is secured within the inlet 132 of the pod assembly 112. In turn, the supply line 120 extends from the inlet 132 along the same axis as the inlet 132. Once again, while the representative embodiment of the invention illustrates a threaded engagement between the supply line 120 and the inlet 132, it is contemplated that other embodiments of the invention may secure the distal end 144 of the supply line 120 within the inlet 132 by other methods.

The outer portion 124*b* of the pod assembly 12 further includes a sensor mount 146 extending laterally from a front side 158 thereof. In other embodiments of the invention, the sensor mount 146 may extend from any side of the outer portion 124*b*. As shown in FIGS. 9-12, the sensor mount 146 includes a frame member 150 surrounding a sensor openings 148. Preferably, the framing member 150 and the main body 124 may be formed as a single piece. However, it is also contemplated that the framing member 150 and the main body 124 may be formed from two separate pieces coupled together.

The sensor 128 is fitted into the sensor opening 148 and extends into the interior 130 of the fixture 110. The sensor 128 is secured to the framing member 150 of the pod assembly 112 via at least one fastener 154. However, it is contemplated that other methods of coupling the sensor 128 and framing member 150 may be used in alternative embodiments of the invention. The sensor 128 includes a sensor housing 156 and a sensor board 152 disposed within a cavity 160 of the sensor housing 156. FIG. 8 depicts the sensor board 152 being located at the bottom of the cavity 160. However, alternative embodiments of the invention may include the sensor board 152 positioned at any location within the cavity 160. Further, the sensor housing 156 and the sensor opening 148 are sized so that the sensor housing 156 may be disposed within the sensor opening 148.

In the representative embodiment of the invention, the intermediate portion 124*c* of the main body 124 of the pod assembly 12 is shown as being circular in shape with a single circular sidewall 162. However, it is contemplated that other embodiments of the invention may include an intermediate portion 124*c* of any shape with any number of sidewalls 162. The pod assembly 112 further includes interfit elements 164, such as locking dogs, extending from the sidewall 162 of the intermediate portion 124*c*. While FIGS. 9-12 depict the locking dogs 164 extending inward from a rear side 166 of the intermediate portion 124*c*, other embodiments of the invention may include the locking dogs 164 extending from any side of the intermediate portion 124*c*. It is preferable that the locking dogs 164 extend from a side of the intermediate portion 124*c* not aligned with the side of the exterior portion 124*b* from which the sensor mount 146 extends. The locking dogs 164 extend from a location above the inlet 122 of the fixture in order to extend into the interior 130 of the fixture 130 to assist in securing the pod assembly 112 within the outlet 116 of the fixture 110.

Figure 9:
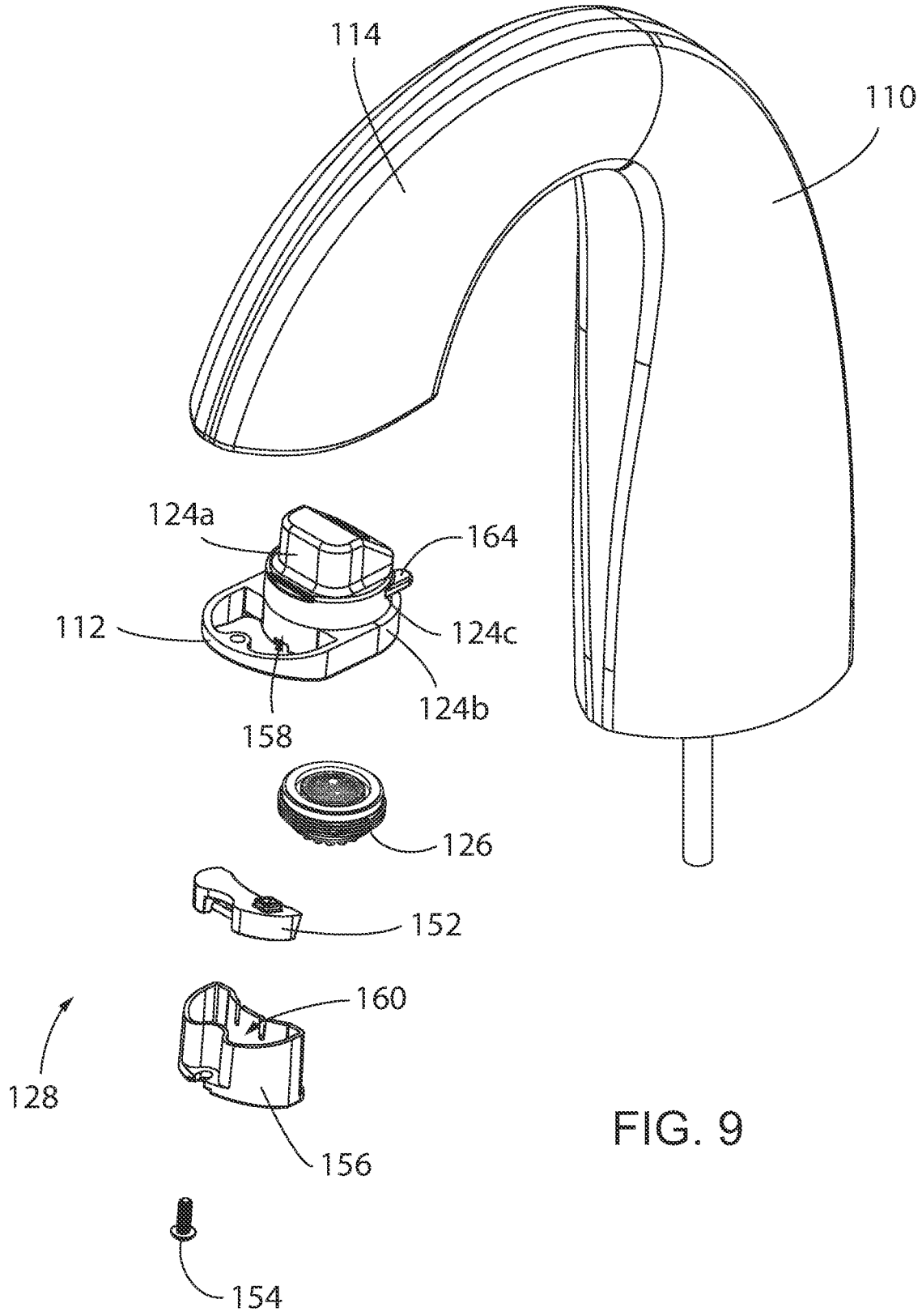
FIG. 9 is an exploded perspective view of the lavatory fixture of FIG. 7.
Figure 10:
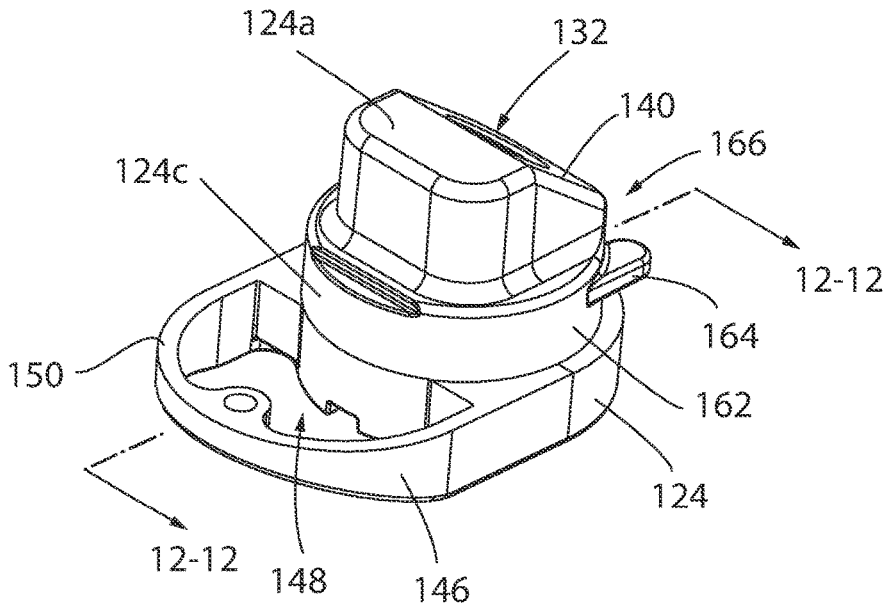
FIG. 10 is a perspective view of the pod assembly of the lavatory fixture of FIG. 7.
Figure 11:
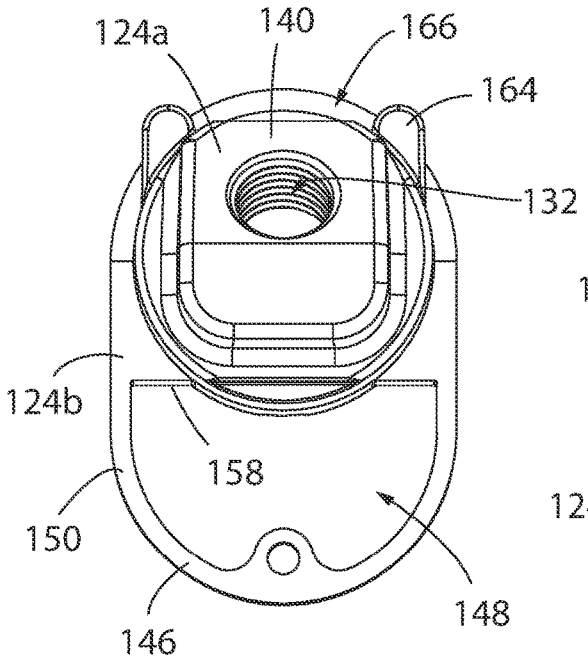
FIG. 11 is a top view of the pod assembly of FIG. 10.
Figure 12:
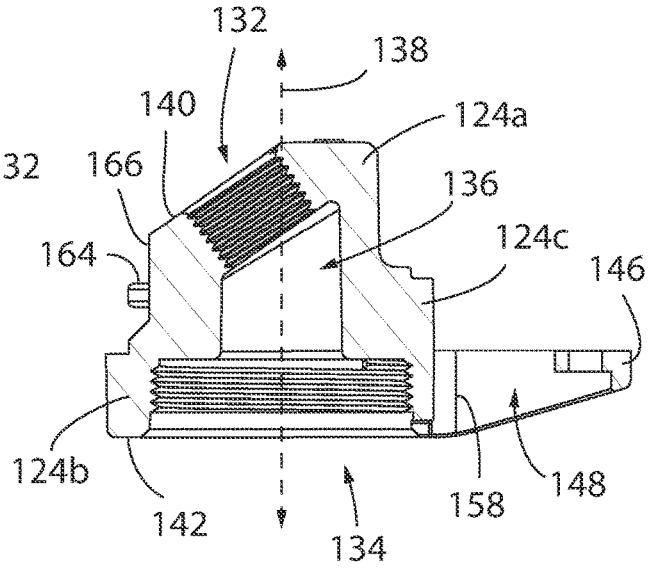
FIG. 12 is a cross-sectional view of the pod assembly of FIG. 10 taken along line 12-12.
Figure 13:
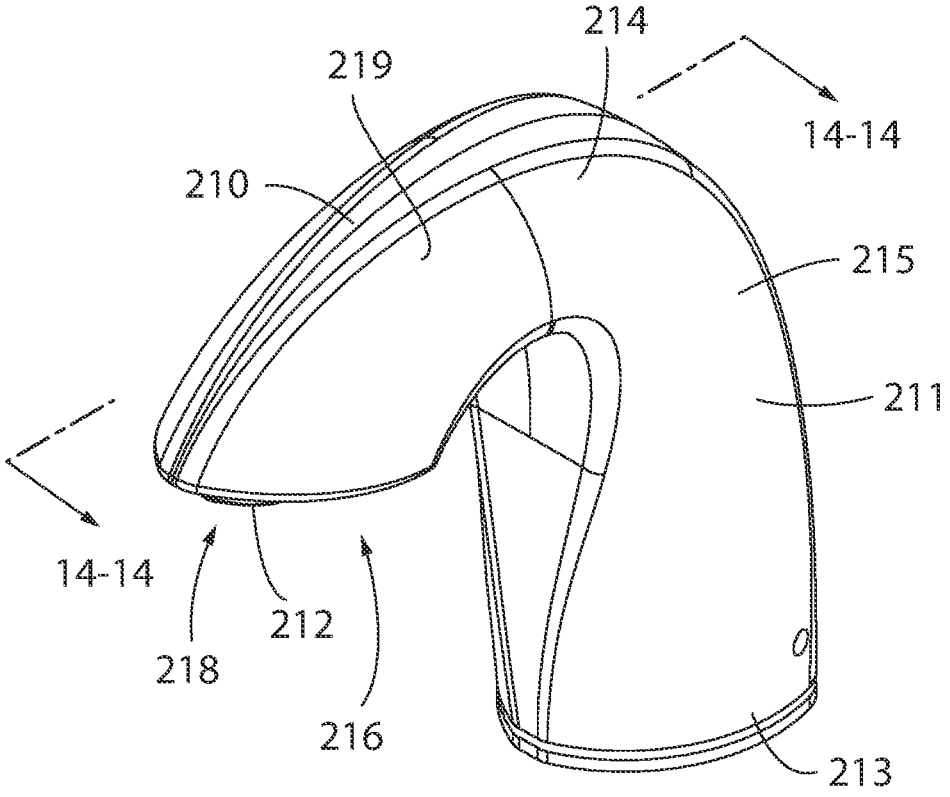
FIG. 13 is perspective view of a lavatory fixture including a pod assembly, according to yet another embodiment of the present invention.

FIG. 9 best depicts the pod assembly 112 within the outlet 116 of the fixture 110. The outer portion 124*b* of the pod assembly 112 is disposed outside the fixture 110 and is sized to be larger than the outlet 116 of the fixture 110. As a result, the outer portion 124*b* of the pod assembly 112 overlaps the fixture 110 adjacent the outlet 116 when the pod assembly 112 is inserted in the outlet 116. The intermediate portion 124*c* is sized to fit within the outlet 116 and allow the sensor 128 to extend into the interior 130 of the fixture 110, as previously discussed. In turn, the locking dogs 164 of the intermediate portion 124*c* extend laterally into the interior 130 of the fixture 110 and assist with securing the pod assembly 112 within the outlet 116 of the fixture 110. In addition, the fastener 156 assists in coupling the framing member 150 of the sensor mount 146 and the sensor 128 to the fixture 110.

Next, FIGS. 13-19 depict a fixture 210 and fixture pod assembly 212 according to yet another embodiment of the invention. The fixture 210 includes a main body 214 with an outlet 216 at the distal end 218 thereof. The pod assembly 212 is disposed within the outlet 216 of the main body 214. A supply line 220 extends from an inlet 222 of the main body 214, through the main body 214, and to the pod assembly 212. The pod assembly 212 includes a main body 224, a dispensing element 226, and a sensor 228, which are all retained within the outlet 216 of the fixture 210. While FIGS. 13-19 depict the dispensing element 226 as a soap dispenser, other embodiments of the invention may include other dispensing elements.

Similar to the main body 14 of the fixture 10 shown in FIGS. 7-12, the main body 24 of the fixture 20 shown in FIGS. 13-19 includes a first portion 211 extending upward from a first end 213 to a second end 215. In turn, the main body 214 includes a second portion 219 that extends from the second end 215 of the first portion 211 along a curve and to the distal end 218 of the main body 214.

FIGS. 14-19 further illustrate the pod assembly 212. The main body 224 of the pod assembly 212 includes an inner portion 224*a* disposed within an interior 230 of the fixture 210, an outer portion 224*b* disposed outside the main body 214 of the fixture 210, and an intermediate portion 224*c* disposed within the outlet opening 216 of the fixture 210 and extending between the inner and outer portions 224*a*, 224*b*. It is contemplated that the portions of the main body 224 may be formed from a single part or separate parts coupled together.

Figure 14:
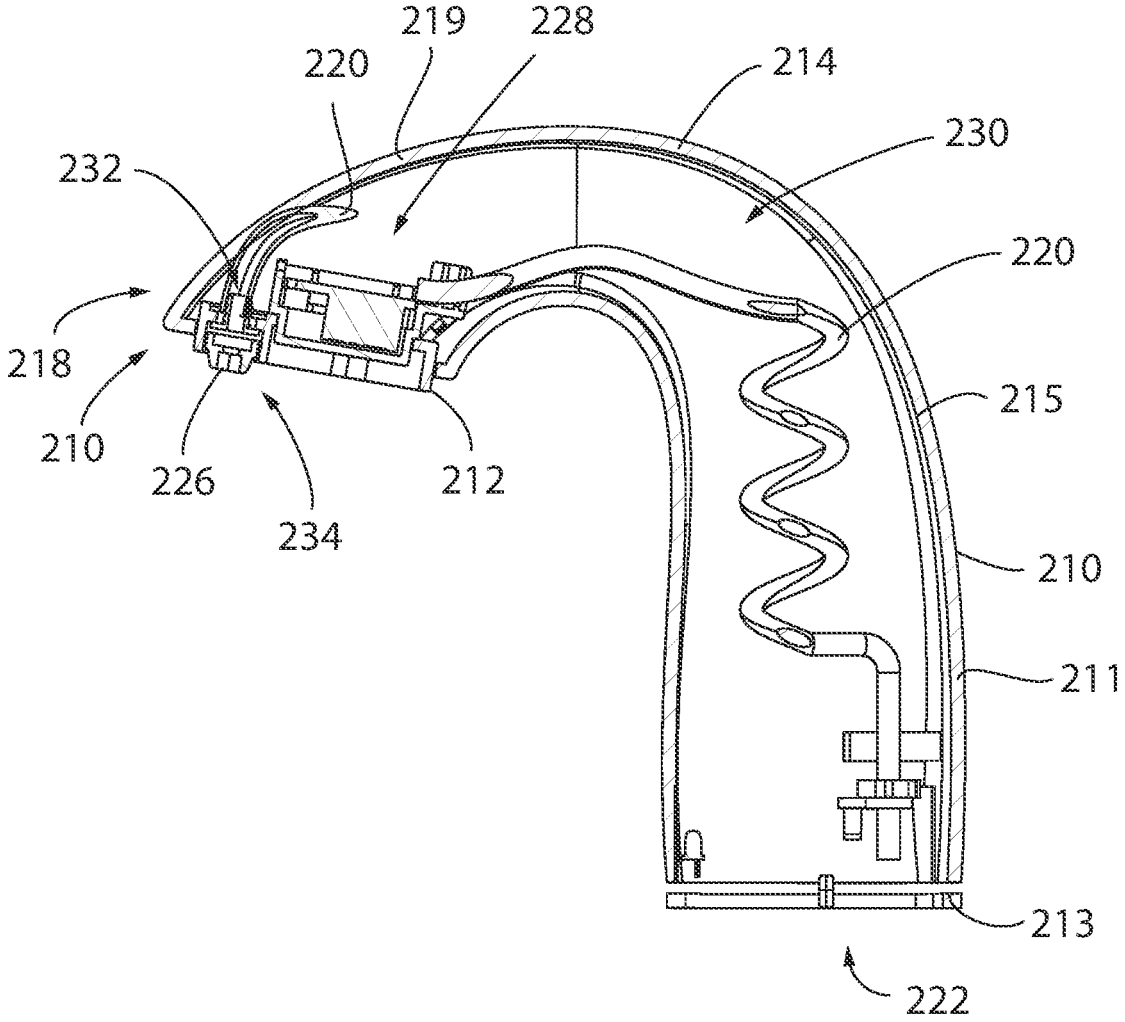
FIG. 14 is a cross-sectional view of the lavatory fixture of FIG. 13 taken along line 14-14.
Figure 15:
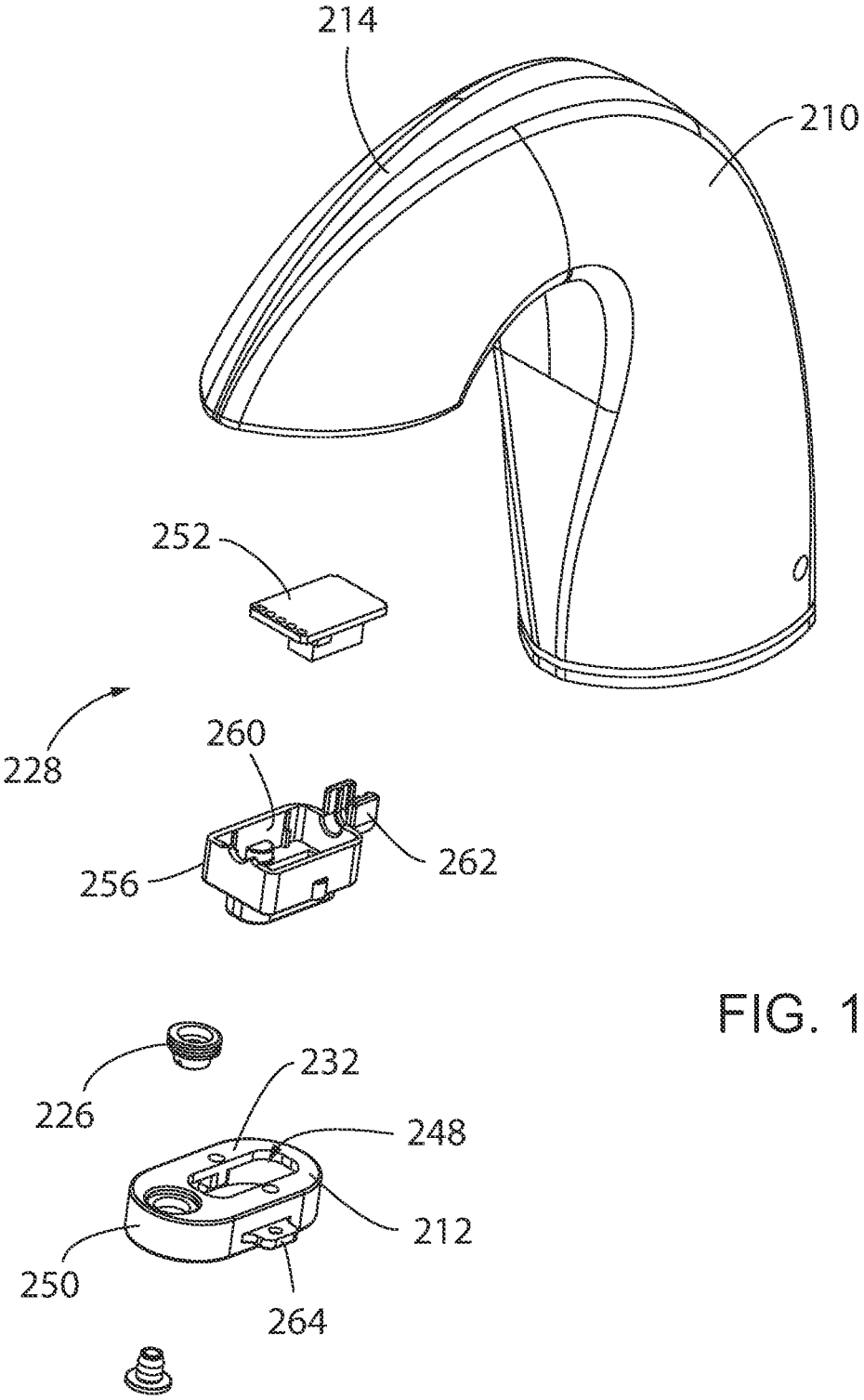
FIG. 15 is an exploded perspective view of the lavatory fixture of FIG. 13.

The main body 224 of the pod assembly 212 further includes an inlet 232 and an outlet 234. The inlet 232 is disposed in the inner portion 224*a* of the pod assembly 212, while the outlet 234 is disposed in the outer portion 224*b* of the pod assembly 212. A channel 236 extends between the inlet 232 and outlet 234. As shown in FIG. 14, the inlet 232, outlet 234, and channel 236 are aligned along an axis 238. The inlet 232 and outlet 234 will be described in further detail below.

The inner portion 224*a* of the main body 224 is depicted as being a mounting surface 240 oriented parallel to the outlet 216 of the faucet 210. The inlet 232 is formed in the mounting surface 240. In addition, a sensor opening 248 is formed through the mounting surface 240 to allow for the sensor 228 to be disposed therein. The outer portion 224*b* and the intermediate portion 224*c* both include a framing member 250 extending downward from the periphery of the mounting surface 240. The framing member 250 further surrounds the outlet 234 of the pod assembly and the channel 236 extending between the outlet 234 and the inlet 232. As discussed above, the soap dispenser 226 is disposed within the outlet 234 of the pod assembly 212.

Figure 16:
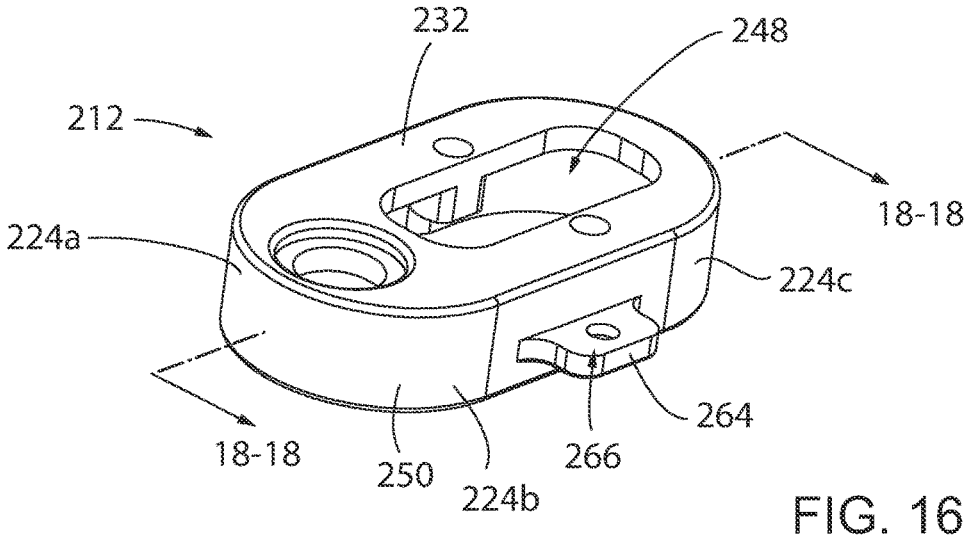
FIG. 16 is a perspective view of the pod assembly of the lavatory fixture of FIG. 13.
Figure 17:
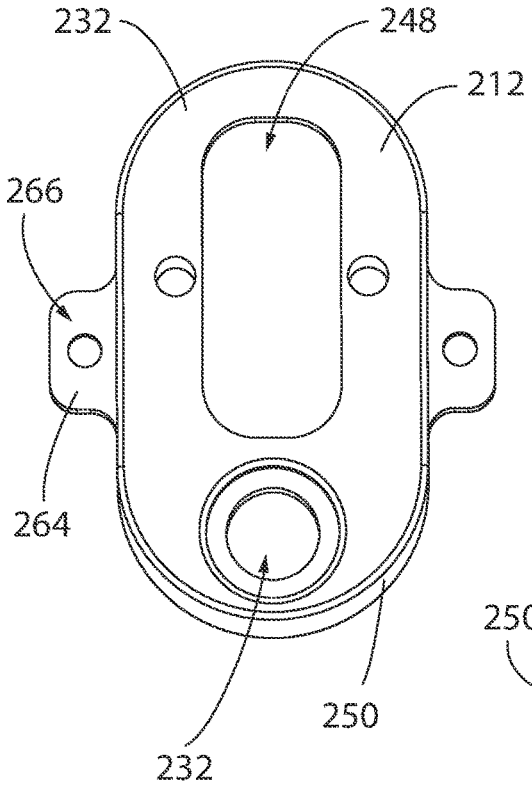
FIG. 17 is a top view of the pod assembly of FIG. 16.
Figure 18:
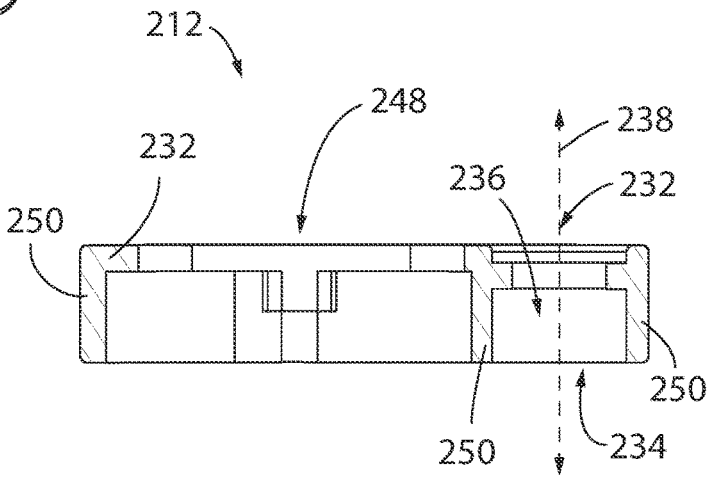
FIG. 18 is a cross-sectional view of the pod assembly of FIG. 16 taken along line 18-18.

The intermediate portion 224*c* further includes at least one extension portion 264 extending outward from the framing member 250. While FIGS. 16-18 depict the pod assembly 212 as including two (2) extension portions 264, other embodiments of the invention may include more or less than two (2) extension portions 264. Each extension portion 264 is configured to interfit with the main body 214 of the fixture 210 adjacent the opening 216. In addition, each extension portion 264 includes an orifice 266 formed therein and configured to receive a fastener 154 to secure the pod assembly 212 to the fixture 210.

As discussed above, the sensor 226 is fitted into the sensor opening 248 and is located within the interior 230 of the fixture 210. The sensor 248 includes a sensor housing 256 and a sensor board 252. As shown in FIG. 14, the sensor board 252 is disposed within a cavity 260 of the sensor housing 256. In the representative embodiment, the sensor housing 256 further includes a clip 262 extending upward from a sidewall 258 thereof. The clip 262 is configured to receive a portion of the supply line 220 to assist in securing the supply line 220 within the interior 230 of the fixture 210.

The sensor housing 256 further includes an upper portion 256*a* and a lower portion 256*b*. The lower portion 256*b* of the sensor housing 256 is configured to extend through the opening 248 in the mounting surface 232 of the fixture pod assembly 212. In turn, the upper portion 256*a* is sized larger than the lower portion 256*b* so as to rest upon the mounting surface 232. Further, at least one fastener may be used to secure the upper portion 256*a* of the sensor housing 256 to the mounting surface 232 of the pod assembly 212.

In other embodiments of the invention, the sensors 28, 128, 228 described in the embodiments above may comprise a dual sensor technology including a time of flight sensor and a diffuse reflective sensor working in tandem to be adaptable to light, color and optimize battery life. The diffuse reflective sensor is always operating, but does so under lower power settings than most other sensors. Meanwhile, the time of flight sensor is more accurate in its detection and has fewer false activations than a diffuse reflective sensor. The time of flight sensor also uses more power than a diffuse reflective sensor. The two sensors work in concert with each other by having the diffuse reflective sensor always in operation. Once the diffuse reflective sensor detects the presence of something, the time of flight sensor is activated to ensure accurate activation of the fixture. By relying on the diffuse reflective sensor to activate the time of flight sensor, the sensor 28, 128, 228 is able to ensure accurate activation of the fixture and provide power optimization to preserve battery life.

The sensor board 52, 152, 252 may include software coding to regulate the dual sensor function of the sensors 28, 128, 228. In addition, the layout of the sensor board 52, 152, 252 is configured to minimize the size of the board 52, 152, 252 with both a time of flight sensor and a diffuse reflective sensor.

The components described above are preferably made of a light weight, durable material including aluminum, polyethylene, or the like.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A fixture pod assembly comprising:

a main body having an inlet and an outlet;

a supply line coupled to the inlet of the main body;

a dispersion element retained within the outlet of the main body;

a sensor disposed within an opening of the main body; and interfit elements extending in a single lateral direction from the main body into a fixture to secure the fixture pod assembly within an outlet of the fixture, the interfit elements extending along an interior surface of the fixture.

2. The fixture pod assembly of claim 1 wherein the dispersion element is one of an aerator and a soap dispenser.

3. The fixture pod assembly of claim 1 wherein the main body includes a framing member surrounding the sensor, and wherein the sensor is secured to the framing member via at least one fastener.

4. The fixture pod assembly of claim 3 wherein the interfit elements extend laterally from a side of the main body not aligned with the framing member.

5. The fixture pod assembly of claim 1 wherein the main body further includes:

an inner portion disposed within an interior of a fixture;

an outer portion disposed outside the interior of the fixture; and an intermediate portion disposed within an outlet of the fixture and extending between the inner portion and the outer portion.

6. The fixture pod assembly of claim 5 wherein the interfit elements extend laterally from the intermediate portion of the main body.

7. The fixture pod assembly of claim 1 wherein a channel extends from the inlet of the main body to the outlet of the main body.

8. The fixture pod assembly of claim 7 wherein the outlet and the channel are aligned along an axis; and wherein the inlet is oriented at an angle to the axis.

9. The fixture pod assembly of claim 1 wherein the sensor includes a time of flight sensor and a diffuse reflective sensor.

10. The fixture pod assembly of claim 1 wherein the interfit elements are disposed entirely within the fixture.

11. A lavatory unit comprising:

a fixture having a main body and an outlet; and a fixture pod assembly retained within the outlet of the fixture, the fixture pod assembly comprising:

a main body having an inlet and an outlet;

a dispersion element retained within the outlet of the main body;

a sensor disposed within an opening of the main body; and locking dogs extending from a single side of the main body into an interior of the fixture to secure the fixture pod assembly within the outlet of the fixture, the locking dogs being disposed entirely within the fixture and extending along an interior surface of the fixture.

12. The lavatory unit of claim 11 further including a supply line extending from an inlet of the fixture to the inlet of the main body of the fixture pod assembly.

13. The lavatory unit of claim 11 wherein the main body includes a framing member surrounding the sensor, and wherein the sensor is secured to the framing member via at least one fastener.

14. The lavatory unit of claim 11 wherein a channel extends from the inlet of the main body to the outlet of the main body; and wherein the outlet of the main body and the channel are aligned along an axis.

15. The lavatory unit of claim 14 wherein the inlet of the main body is oriented at an angle to the axis.

16. The lavatory unit of claim 14 wherein the inlet of the main body is oriented perpendicular to the axis.

17. A method of installing a fixture pod assembly in a fixture comprising:

disposing a main body of the fixture pod assembly within an outlet of the fixture;

inserting a dispersion element into an outlet of the main body of the fixture pod assembly;

inserting a sensor into an opening formed in the main body of the fixture pod assembly; and inserting locking dogs into an interior of the fixture, wherein the locking dogs extend in a single lateral direction from the main body of the fixture pod assembly and along an interior surface of the fixture.

18. The method of claim 17 further comprising securing a supply line to an inlet of the main body of the fixture pod assembly.

19. The method of claim 17 further comprising securing the sensor of the main body of the fixture pod assembly via at least one fastener.

20. The method of claim 17 further comprising securing the main body of the fixture pod assembly to the fixture via at least one fastener.

* * * * *